US009823012B2

(12) United States Patent
Wantland et al.

(10) Patent No.: US 9,823,012 B2
(45) Date of Patent: Nov. 21, 2017

(54) STORAGE ASSEMBLY FOR AN APPLIANCE

(71) Applicant: General Electric Company, Schenectady, NY (US)

(72) Inventors: Louis A. Wantland, Louisville, KY (US); Bagawathkumar Chellappan, Louisville, KY (US); Satish Gundala, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/082,225

(22) Filed: Mar. 28, 2016

(65) Prior Publication Data

US 2017/0276424 A1 Sep. 28, 2017

(51) Int. Cl.

| | |
|---|---|
| ***F25D 25/00*** | (2006.01) |
| ***F25D 23/04*** | (2006.01) |
| ***F25D 11/02*** | (2006.01) |
| ***F25D 23/06*** | (2006.01) |
| ***F25D 23/08*** | (2006.01) |
| ***F25D 25/02*** | (2006.01) |

(52) U.S. Cl.

CPC ..... *F25D 25/005* (2013.01); *F25D 11/02* (2013.01); *F25D 23/04* (2013.01); *F25D 23/066* (2013.01); *F25D 23/069* (2013.01); *F25D 23/085* (2013.01); *F25D 25/025* (2013.01); *F25D 2400/06* (2013.01)

(58) Field of Classification Search

CPC ..... F25D 23/04; F25D 2325/00; F25D 2325/021; F25D 25/02; F25D 25/021; F25D 25/022; F25D 25/027; F25D 25/005; A47B 57/06; A47B 57/08; A47B 57/10; A47B 57/12; A47B 57/14; A47B 57/16; A47B 57/20; A47B 57/26; A47B 57/265; A47B 57/30; A47B 57/32; A47B 57/34; A47B 57/36; A47B 57/38; A47B 57/40; A47B 57/42; A47B 57/425; A47B 57/48; A47B 57/482; A47B 57/485; A47B 57/54; A47B 57/545

See application file for complete search history.

(56) References Cited

U.S. PATENT DOCUMENTS

| | | | | |
|---|---|---|---|---|
| 1,687,149 A | | 10/1928 | Shauer et al. | |
| 2,693,989 A | | 11/1954 | Santana et al. | |
| 2,836,305 A | | 5/1958 | Davey et al. | |
| 2,955,892 A | * | 10/1960 | Pulaski | A47B 49/004 211/150 |
| 3,063,775 A | * | 11/1962 | Snowman | F25D 25/027 108/141 |

(Continued)

FOREIGN PATENT DOCUMENTS

| | | | | |
|---|---|---|---|---|
| CN | 103453724 A | * | 12/2013 | F25D 25/02 |
| CN | WO 2015032042 A1 | * | 3/2015 | F25D 25/02 |

(Continued)

*Primary Examiner* — Andrew M Roersma

(74) *Attorney, Agent, or Firm* — Dority & Manning P.A.

(57) ABSTRACT

A storage assembly for an appliance includes a shaft mounted to the bracket. A hinge is slidably mounted to the shaft, and a container is mounted to the hinge such that the container is movable relative to the shaft on the hinge. The container has a projection that is receivable within each opening of a series of openings of the shaft. A related refrigerator appliance is also provided.

10 Claims, 6 Drawing Sheets

(56) References Cited

U.S. PATENT DOCUMENTS

| | | | | | |
|---|---|---|---|---|---|
| 3,167,186 | A * | 1/1965 | Squire | F25D 25/027 | 108/141 |
| 3,187,517 | A | 6/1965 | Carbary | | |
| 4,174,486 | A * | 11/1979 | Winkler | A47B 57/567 | 108/152 |
| 4,829,653 | A * | 5/1989 | Stich | F25D 23/04 | 29/458 |
| 5,685,624 | A | 11/1997 | Lee | | |
| 5,810,462 | A | 9/1998 | Lee | | |
| 8,322,804 | B2 * | 12/2012 | Kim | F25D 23/04 | 312/321.5 |
| 8,641,158 | B1 | 2/2014 | Conner, Sr. | | |
| 9,103,581 | B2 | 8/2015 | Babinski et al. | | |
| 2010/0270902 | A1 * | 10/2010 | Kim | F25D 17/042 | 312/405.1 |
| 2012/0018435 | A1 * | 1/2012 | Kim | F25D 23/04 | 220/592.02 |
| 2014/0238383 | A1 * | 8/2014 | Armstrong | F24C 15/16 | 126/337 A |

FOREIGN PATENT DOCUMENTS

| | | | | | |
|---|---|---|---|---|---|
| DE | 1011718 | B * | 7/1957 | A47B 57/30 | |
| DE | 9200558 | U1 * | 3/1992 | A47B 57/34 | |
| DE | 19633975 | A1 * | 2/1998 | A47B 57/20 | |
| KR | 1020150045749 | A * | 4/2015 | F25D 23/04 | |
| NL | EP 0686817 | A2 * | 12/1995 | A47B 75/00 | |
| TR | WO 2012062883 | A2 * | 5/2012 | F25D 23/04 | |
| WO | WO2011080192 | A2 | 7/2011 | | |
| WO | WO2012062883 | A2 | 5/2012 | | |

* cited by examiner

STORAGE ASSEMBLY FOR AN APPLIANCE

FIELD OF THE INVENTION

The present subject matter relates generally to storage assemblies within appliances, such as refrigerator appliances.

BACKGROUND OF THE INVENTION

Refrigerator appliances generally include a cabinet that defines a chilled chamber for receipt of food articles for storage. The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

A design goal for refrigerator appliances can include providing flexibility and customizability in arranging storage components within the appliance's chilled chamber. Such flexibility can improve consumer satisfaction with the appliance. Consequently, the storage components of certain refrigerator appliances can be adjusted or repositioned within the chilled chamber depending upon the configuration desired or selected by a user. However, repositioning storage components offers limited flexibility in arranging such storage components. In addition, accessing food items at back of the storage components can be difficult even after repositioning the storage components within the chilled chamber.

Accordingly, a refrigerator appliance with features for improving storage of food items within a chilled chamber of the appliance would be useful. In particular, a refrigerator appliance with features for facilitating access to items located at a back of a storage feature would be useful.

BRIEF DESCRIPTION OF THE INVENTION

The present subject matter provides a storage assembly for an appliance. The storage assembly includes a shaft mounted to the bracket. A hinge is slidably mounted to the shaft, and a container is mounted to the hinge such that the container is movable relative to the shaft on the hinge. The container has a projection that is receivable within each opening of a series of openings of the shaft. A related refrigerator appliance is also provided. Additional aspects and advantages of the invention will be set forth in part in the following description, or may be apparent from the description, or may be learned through practice of the invention.

In a first exemplary embodiment, a refrigerator appliance is provided. The refrigerator appliance includes a cabinet that defines a chilled chamber. A storage assembly is disposed within the chilled chamber of the cabinet. The storage assembly includes a bracket. A shaft mounted to the bracket. The shaft defines a series of openings. A hinge is slidably mounted to the shaft. A container is mounted to the hinge such that the container is movable relative to the shaft on the hinge. The container has a projection that is receivable within each opening of the series of openings of the shaft. The container is positioned at a respective vertical height on the shaft when the projection of the container is received within each opening of the series of openings of the shaft.

In a second exemplary embodiment, a storage assembly for an appliance is provided. The storage assembly includes a bracket. A shaft is mounted to the bracket. The shaft defines a series of openings. A hinge is slidably mounted to the shaft. A container is mounted to the hinge such that the container is movable relative to the shaft on the hinge. The container has a projection that is receivable within each opening of the series of openings of the shaft. The container is positioned at a respective vertical height on the shaft when the projection of the container is received within each opening of the series of openings of the shaft.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
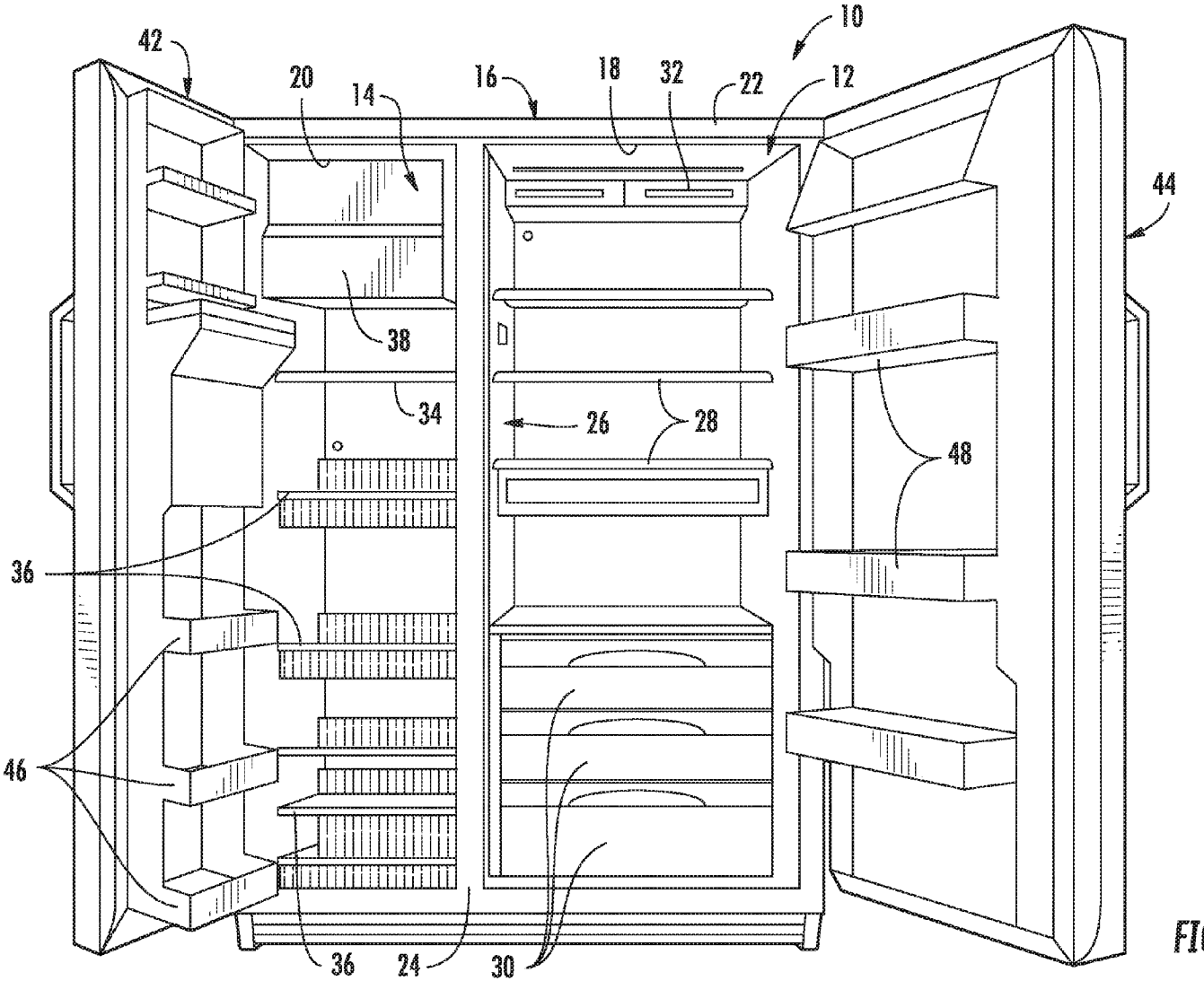
FIG. 1 provides a front, elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, elevation view of a refrigerator appliance 10 according to an exemplary embodiment of the present subject matter. More specifically, for illustrative purposes, the present subject matter is described with refrigerator appliance 10 having a construction as shown and described further below. As used herein, "refrigerator appliance" includes appliances such as a refrigerator/freezer combination, side-by-side, bottom mount, compact, and any other style or model of refrigerator appliance. Accordingly, other configurations including multiple and different styled compartments could be used with refrigerator appliance 10, it being understood that refrigerator appliance 10 shown in FIG. 1 is provided by way of example only.

Refrigerator appliance 10 includes a fresh food storage compartment 12 and a freezer storage compartment 14. Freezer compartment 14 and fresh food compartment 12 are arranged side-by-side within a cabinet or housing that includes an outer case 16 and inner liners 18, 20. Freezer compartment 14 and fresh food compartment 12 are defined by inner liners 18 and 20 within outer case 16. A space between case 16 and liners 18 and 20, and between liners 18 and 20, is filled with foamed-in-place insulation. Outer case 16 normally is formed by folding a sheet of a suitable material, such as pre-painted steel, into an inverted U-shape to form the top and side walls of case 16. A bottom wall of case 16 normally is formed separately and attached to the case side walls and to a bottom frame that provides support for refrigerator appliance 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel.

A breaker strip 22 extends between a case front flange and outer front edges of liners 18, 20. Breaker strip 22 is formed from a suitable resilient material, such as an extruded acrylo-butadiene-styrene based material (commonly referred to as ABS). The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26.

An ice maker 38 may be provided in freezer compartment 14. A freezer door 42 and a fresh food door 44 close access openings to freezer and fresh food compartments 14, 12, respectively. Each door 42, 44 is mounted to rotate about its outer vertical edge between an open position, as shown in FIG. 1, and a closed position (not shown) closing the associated storage compartment.

Shelves 28 and slide-out storage drawers 30, sometimes referred to as storage pans, are provided in fresh food compartment 12 to support items being stored therein. A shelf 34 and wire baskets 36 are also provided in freezer compartment 14. Freezer door 42 includes a plurality of storage shelves 46, and fresh food door 44 includes a plurality of storage shelves 48. Thus, refrigerator appliance 10 includes various storage assemblies on cabinet 12, freezer door 42 and/or fresh food door 44 for supporting food items within fresh food compartment 12 and freezer compartment 14.

Figure 2:
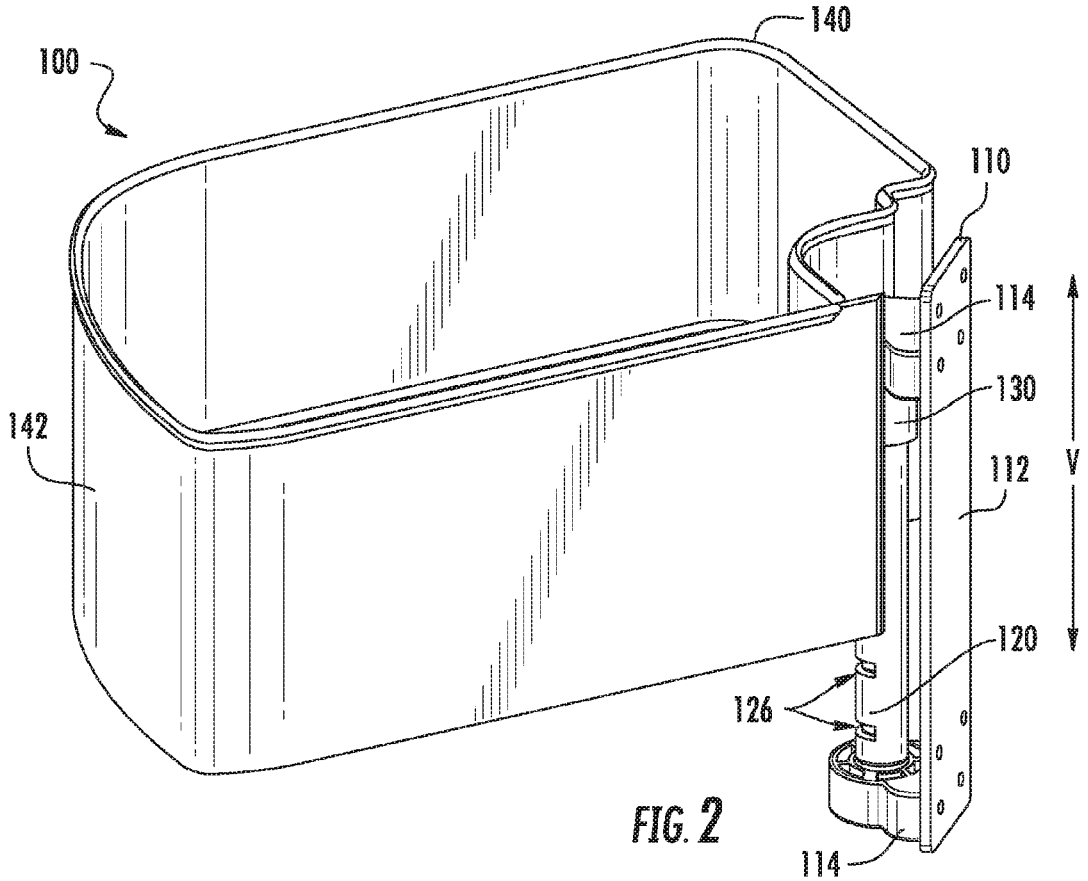
FIG. 2 provides a perspective view of a storage assembly according to an exemplary embodiment of the present subject matter with a container of the exemplary storage assembly shown at a first vertical height.
Figure 11:
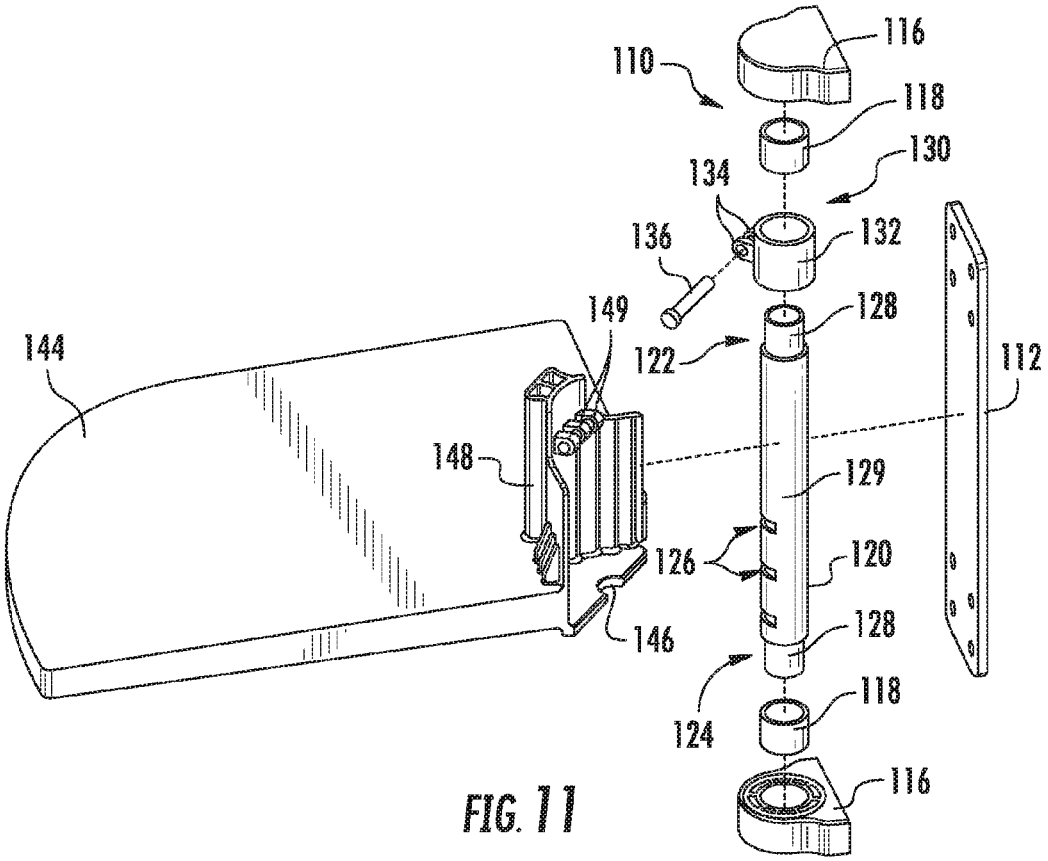
FIG. 11 provides an exploded view of the exemplary storage assembly of FIG. 2.

FIG. 2 provides a perspective view of a storage assembly 100 according to an exemplary embodiment of the present subject matter. FIG. 11 provides an exploded view of storage assembly 100. Storage assembly 100 may be used in or with any suitable appliance. For example, storage assembly 100 may be used in refrigerator appliance 100, e.g., as one of shelves 28, shelf 34, shelves 46, storage shelves 48, etc., and food items within refrigerator appliance 10 may be disposed within or on storage assembly 100. Thus, storage assembly 100 is described in greater detail below in the context of refrigerator appliance 10.

In FIG. 2, a container 140 of storage assembly 100 is shown at a first vertical height. Conversely, in FIG. 7, container 140 of storage assembly 100 is shown at a second vertical height, different than the first vertical height. FIGS. 3-6 provide perspective views of storage assembly 100 during height adjustment of container 140 from the first vertical height to the second vertical height. Thus, a shown in FIGS. 2-7, a position of container 140 along a vertical direction V is selectively adjustable such that a user of storage assembly 100 may select and adjust a desired position for container 140 along the vertical direction V. In such a manner, storage of items below or within storage assembly 100 may be facilitated. For example, if more space is needed below storage assembly 100, the user may move container 140 upwardly along the vertical direction V. Conversely, if more space is need above storage assembly 100, container 140 may be moved downwardly along the vertical direction V. In addition, container 140 may be moved upwardly and/or downwardly along the vertical direction V until tall items within container 140 are positioned at a bottom of an adjacent bin. Features of storage assembly 100 that assist with allowing container 140 to move along the vertical direction V are discussed in greater detail below.

As may be seen in FIGS. 2 and 11, storage assembly 100 includes a bracket 110 and a shaft 120. Bracket 110 includes a mounting plate 112 and a pair of bearing assemblies 114. Bearing assemblies 114 are mounted to mounting plate 112 and are positioned at opposite ends of mounting plate 112, e.g., along the vertical direction V. Thus, bearing assemblies 114 may be spaced apart from each other along the vertical direction V on mounting plate 112. As shown in FIG. 11, bearing assemblies 114 each include a holder 116 and a bearing sleeve 118. Holder 116 may be mounted to mounting plate 112, e.g., such that holder 116 is fixed or static relative to mounting plate 112, and bearing sleeve 118 is received or disposed within holder 116, e.g., such that bearing sleeve 118 is rotatable relative to holder 116.

Shaft 120 is, e.g., rotatably, mounted to bracket 110 with bearing assemblies 114. For example, end portions of shaft 120 may be received within bearing sleeves 118 of bracket 110 such that shaft 120 is rotatable relative to bracket 110 on bearing assemblies 114. Shaft 120 also defines a series of openings 126. Openings 126 of shaft 120 may be distributed or spaced apart from one another along the vertical direction V.

Bracket 110 may assist with mounting shaft 120 to a structural component of refrigerator appliance 10. For example, bracket 110 may be mounted to the cabinet, e.g., one of inner liners 18, 20, of refrigerator appliance 10 such that bracket 110 is fixed relative to the cabinet. Thus, container 140 of storage assembly 100 may be rotatable relative to the cabinet of refrigerator appliance on shaft 120. As another example, bracket 110 may be mounted to one of doors 42, 44 of refrigerator appliance 10 such that bracket 110 is fixed relative to the doors 42, 44. Thus, container 140 of storage assembly 100 may be rotatable relative to the doors 42, 44 of refrigerator appliance 10 on shaft 120. Fasteners may extend through mounting plate 112 into refrigerator appliance 10 in order to mount bracket 110 within refrigerator appliance 10. In alternative exemplary embodiments, any other suitable method or mechanism, such as adhesive, may be used to mount mounting plate 112 within refrigerator appliance 10.

Storage assembly 100 also includes a hinge 130. Hinge 130 is slidably mounted to shaft 120 and rotatably couples container 140 to shaft 120. Thus, container 140 is mounted to hinge 130 such that container 140 is movable along the vertical direction V relative to shaft 120 on hinge 130. Hinge 130 may be positioned above openings 126 on shaft 120. Container 140 is also mounted to hinge 130 such that container 140 is rotatable relative to shaft 120 with hinge 130. For example, hinge 130 includes a tubular member 132 with pin bearings 134 and a pin 136. Tubular member 132 of hinge 130 is received on shaft 120 such that tubular member 132 is movable along the vertical direction V on shaft 120 and is also rotatable about pin 136, e.g., in a plane that is perpendicular to the vertical direction V.

Container 140 may include a bin 142 and a support plate 144. Support plate 144 may be rotatably coupled to shaft 120 with hinge 130. For example, support plate 144 may include a post 148 that extends upwardly along the vertical direction V. Post 148 may include pin bearings 149 at or adjacent a distal end of post 148, and pin bearings 149 may mesh with pin bearings 134 of tubular member 132 to assist with rotatably coupling container 140 onto shaft 120 with hinge 130. For example, pin 136 may extend through pin bearings 134 of tubular member 132 and pin bearings 149 of post 148 in order to rotatably couple tubular member 132 to post 148 and thereby container 140 to shaft 120.

Bin 142 is receivable on support plate 144. Thus, bin 142 may rest on support plate 144, as shown in FIG. 2. Bin 142 may also be removed from support plate 144, e.g., to permit height adjustment of container 140 along the vertical direction V and/or cleaning of bin 142. In alternative exemplary embodiments, storage assembly 100 need not include separate bin 142 and support plate 144, rather bin 142 and support plate 144 may be integrally formed with a single continuous piece of material, such as molded plastic.

Container 140 has a projection, edge or lip 146 that is receivable within each opening of openings 126 of shaft 120. In certain exemplary embodiments, support plate 144 may define lip 146. As discussed in greater detail below with reference to FIGS. 2-7, container 140 is positioned at a respective vertical height on shaft 120 when lip 146 of container 140 is received within each opening of openings 126 of shaft 120. It should be understood that lip 146 is provided by way of example only and that container 140 may include any other suitable projection or protrusion for engaging shaft 120, in alternative exemplary embodiments. For example, container 140 may include a projection formed as a pin that is receivable within each opening of openings 126 of shaft 120.

As shown in FIG. 11, shaft 120 may extend between a top end portion 122 and a bottom end portion 124, e.g., along the vertical direction V. Top end portion 122 of shaft 120 and bottom end portion 124 of shaft 120 may each be received within a respective one of bearing assemblies 114 (e.g., a respective one of bearing sleeves 118). Shaft 120 may also include an inner tube 128 and an outer tube 129. Inner tube 128 may be received within outer tube 129, e.g., by sliding outer tube 129 over inner tube 128. Outer tube 129 may define openings 126 and may be shorter than inner tube 128, e.g., along the vertical direction V. End portions of inner tube 128 may be received within bearing assemblies 114 (e.g., bearing sleeves 118) while outer tube 129 is disposed between bearing assemblies 114 along the vertical direction V. For example, outer tube 129 may extend between bearing assemblies 114 along the vertical direction V.

Figure 3:
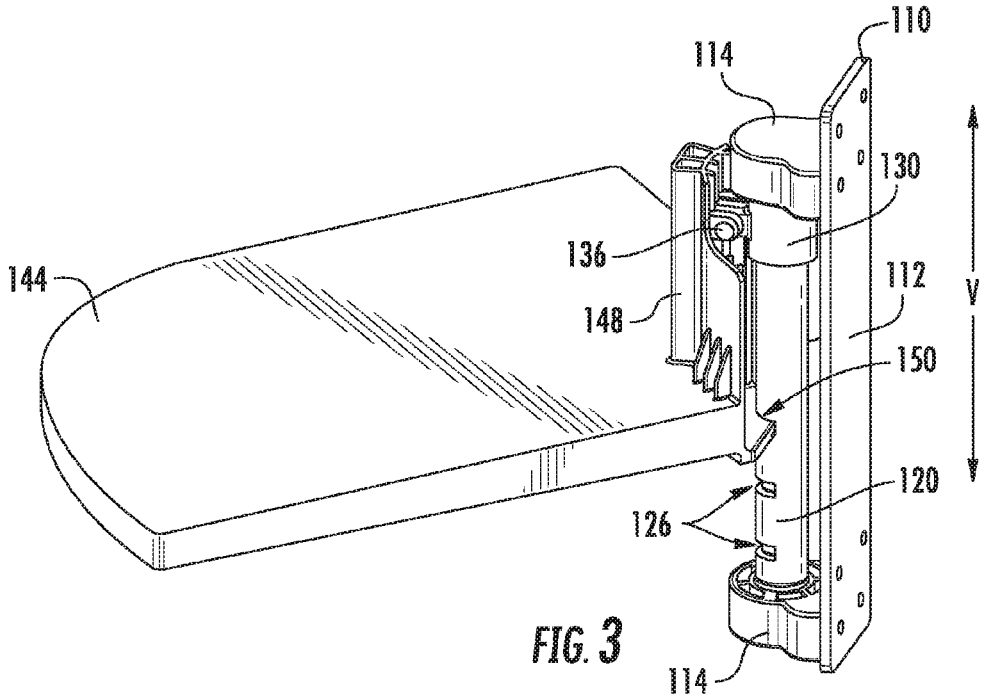
FIGS. 3-6 provide perspective views of the exemplary storage assembly of FIG. 2 during height adjustment of the container of the exemplary storage assembly.
Figure 4:
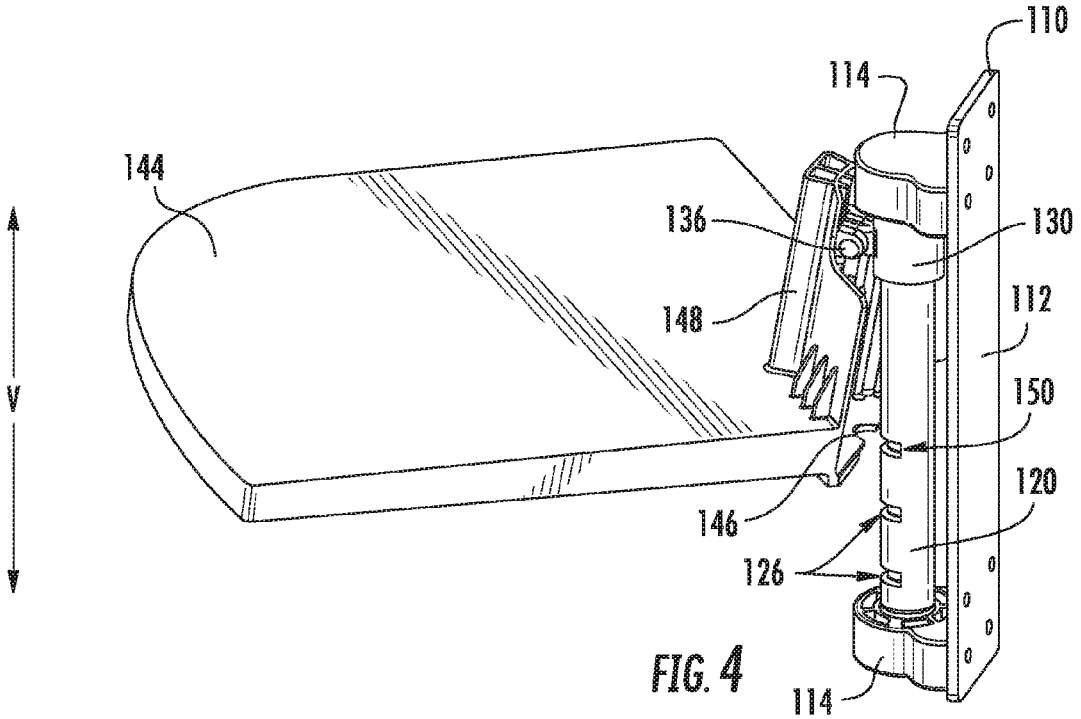
Figure 5:
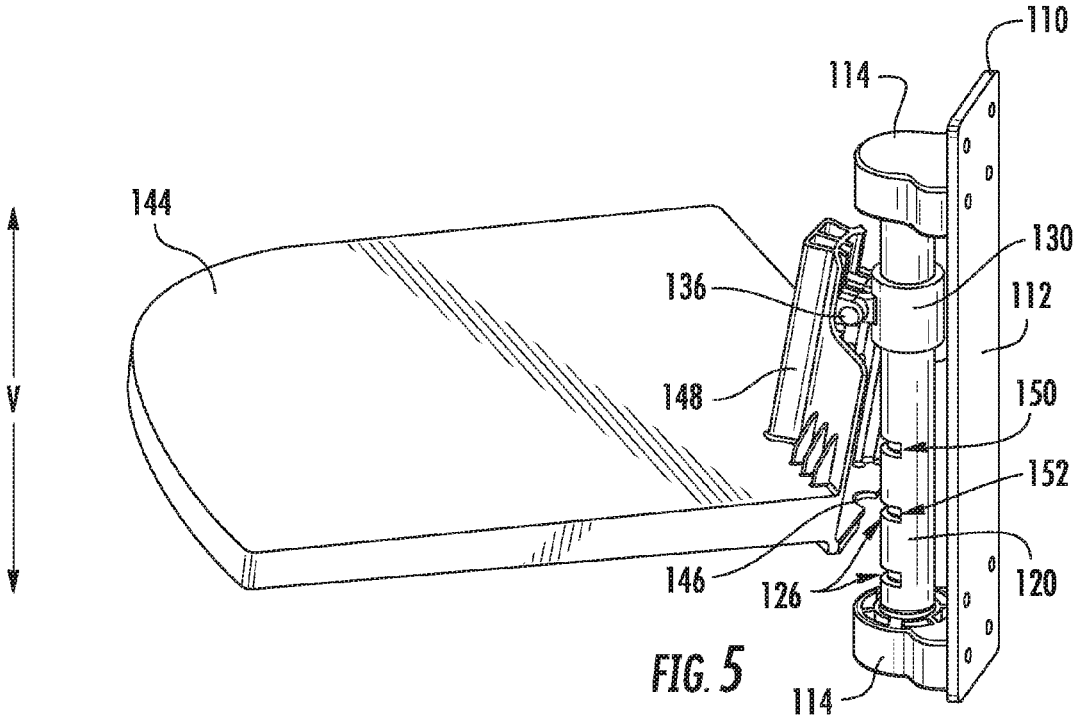
Figure 6:
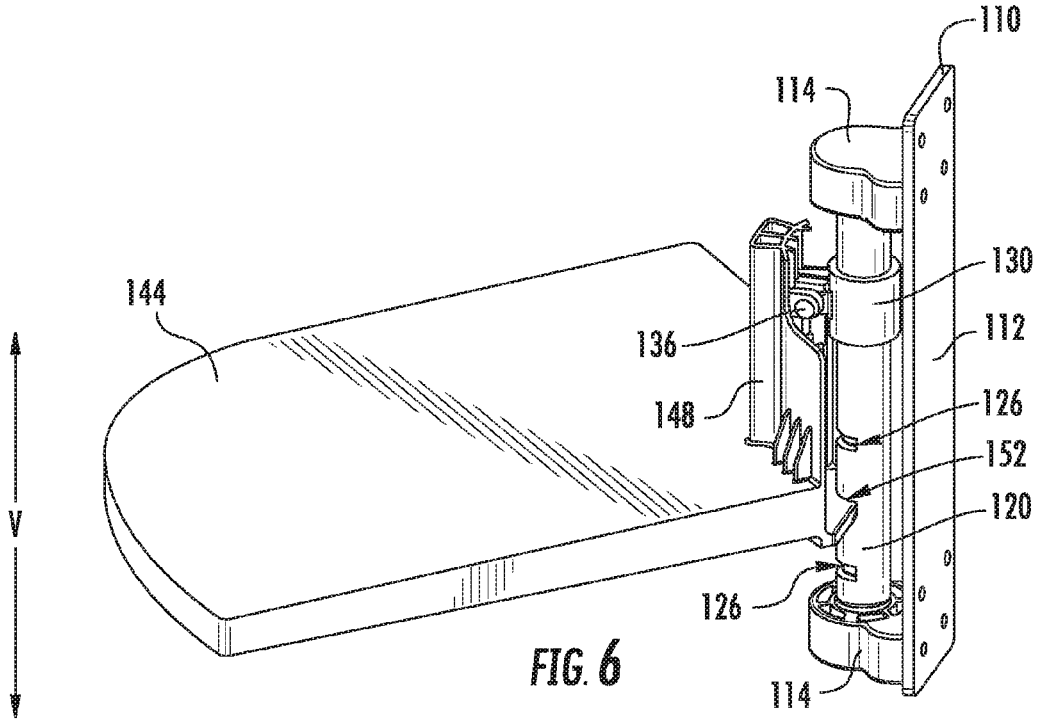

Turning now to FIGS. 3-6, adjustment of storage assembly 100 from the first vertical height (FIG. 2) to the second vertical height (FIG. 7) is discussed in greater detail below. As shown in FIG. 3, bin 142 may be removed from support plate 144. With bin 142 removed from support plate 144, support plate 144 may be rotated on hinge 130 relative to shaft 120 such that lip 146 of container 140 is removed from a first one 150 of openings 126, as shown in FIG. 4. With lip 146 removed from first one 150 of openings 126, hinge 130 may move along the vertical direction V on shaft 120 with container 140. For example, hinge 130 may move downwardly along the vertical direction V on shaft 120 with container 140 from the position shown in FIG. 4 to the position shown in FIG. 5. To fix the vertical position of container 140 on shaft 120 at the second vertical height, lip 146 of container 140 may be inserted into a second one 152 of openings 126. For example, support plate 144 may be rotated on hinge 130 relative to shaft 120 such that lip 146 of container 140 is inserted into second one 152 of openings 126, as shown in FIG. 6. When lip 146 is inserted into second one 152 of openings 126, lip 146 engages shaft 120 such that shaft 120 hinders or blocks movement of container 140 downwardly along the vertical direction V, e.g., due to gravity. Thus, lip 146 of container 140 may engage shaft 120 at each opening of openings 126 in order to secure container 140 at a respective vertical height on shaft 120.

Figure 7:
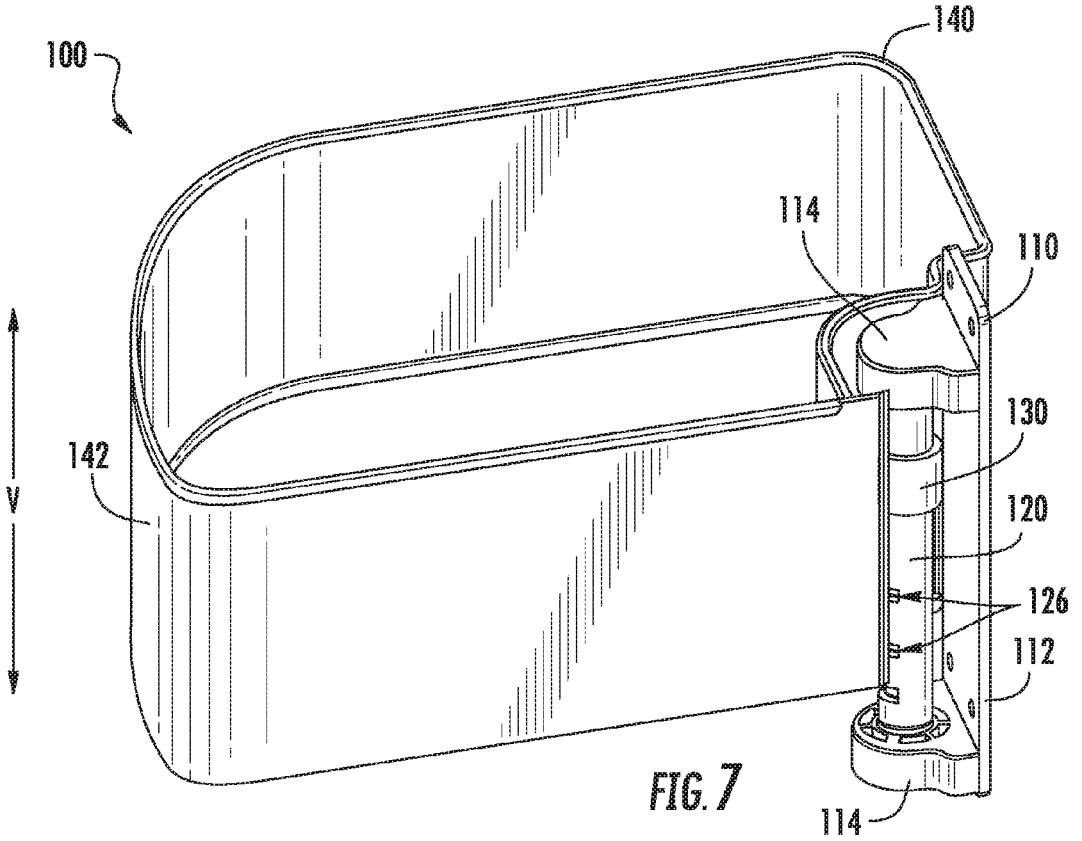
FIG. 7 provides a perspective view of the exemplary storage assembly of FIG. 2 with the container of the exemplary storage assembly shown at a second vertical height.
Figure 8:
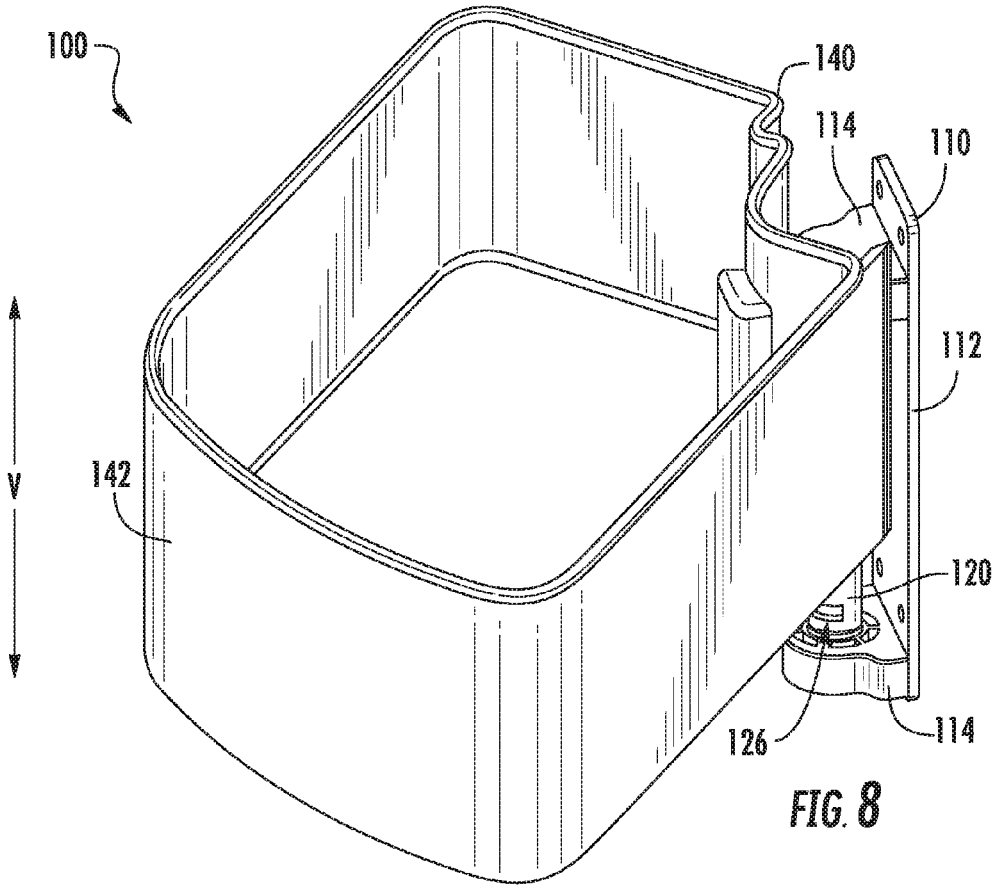
FIGS. 8 and 9 provide perspective views of the exemplary storage assembly of FIG. 2 during rotation of the container of the exemplary storage assembly.
Figure 9:
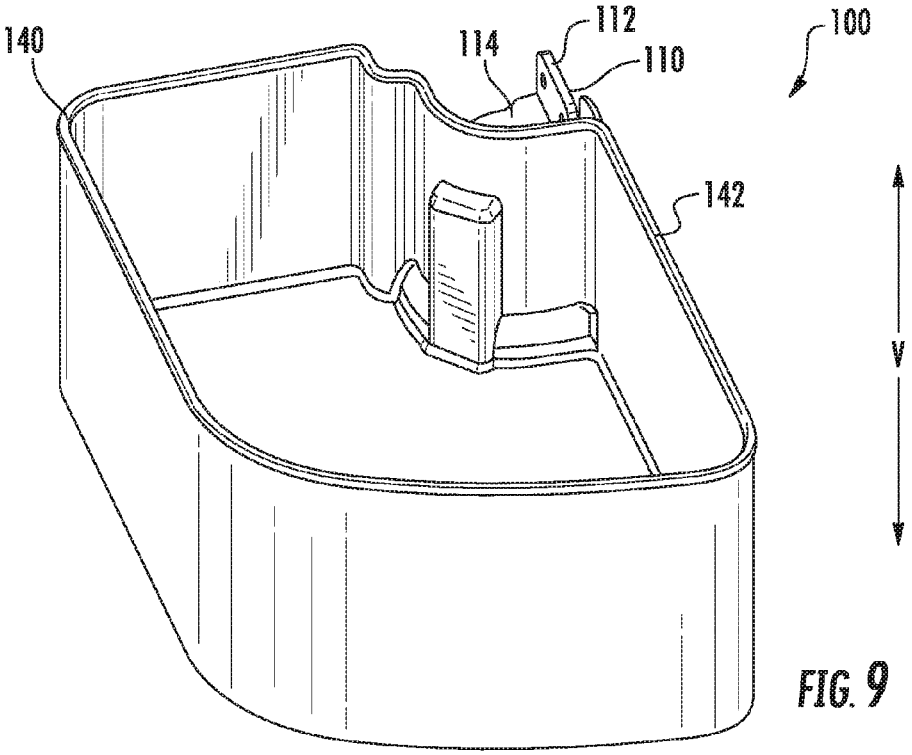

FIGS. 7, 8 and 9 provide perspective views of storage assembly 100 during rotation of container 140 on shaft 120. As discussed above, hinge 130 may be rotatable on shaft 120 and/or shaft 120 may be rotatable on bracket 110. Thus, container 140 may also be rotatable between a first position (FIG. 7) and a second position (FIG. 9) on shaft 120. Container 140 is shown between the first and second positions in FIG. 8. By rotating between the first and second positions, access to items within container 140 may be facilitated. For example, container 140 may be rotated away from inner liners 18, 20 or doors 42, 44 of refrigerator appliance 10 in order to facilitate access to items at a back of bin 142. Thus, container 140 may rotate about or on shaft 120 in addition to being movable along the vertical direction V on shaft 120.

Figure 10:
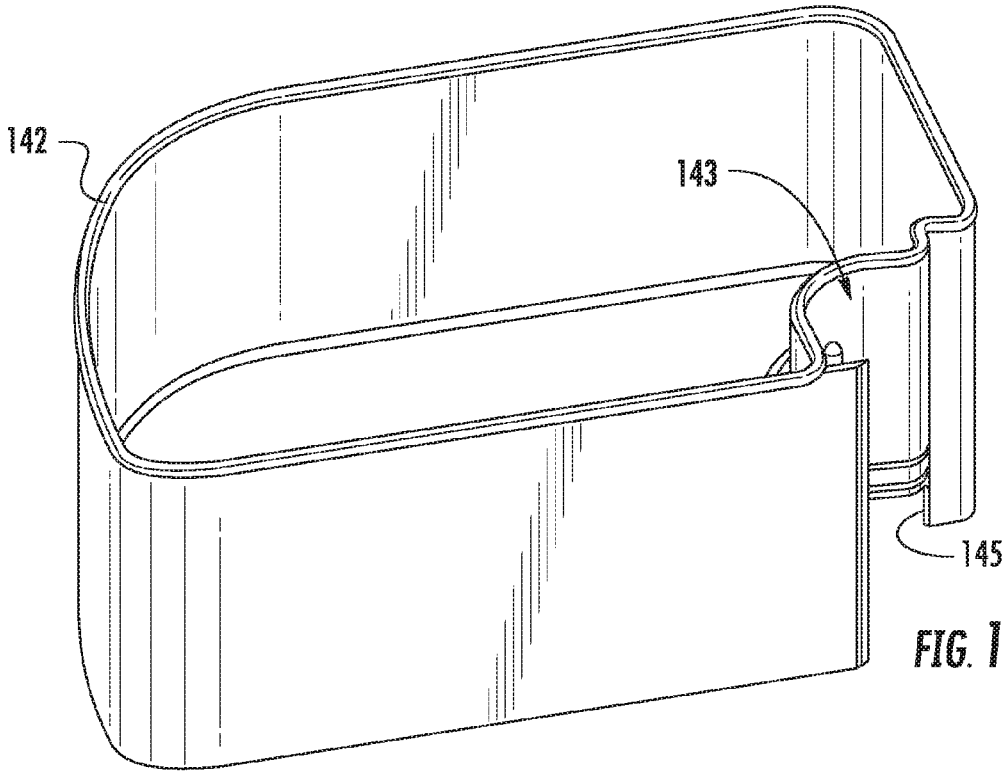
FIG. 10 provides a perspective view of a bin of the exemplary storage assembly of FIG. 2.

FIG. 10 provides a perspective view of bin 142. As shown in FIG. 10, bin 142 defines a pocket 143 that receives post 148 of support plate 144 when bin 142 is disposed on support plate 144. Pocket 143 may be positioned at a corner of bin 142. Bin 142 also includes a shroud 145 that extends around at least a portion of support plate 144 at a bottom of bin 142 when bin 142 is disposed on support plate 144. Shroud 145 may assist with hiding support plate 144, as shown in FIGS. 2 and 7, when bin 142 is disposed on support plate 144 in order to improve a cosmetic appearance of container 140.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a chilled chamber;

a storage assembly disposed within the chilled chamber of the cabinet, the storage assembly comprising a bracket;

a shaft mounted to the bracket, the shaft defining a series of openings;

a hinge slidably mounted to the shaft; and a container mounted to the hinge such that the container is movable relative to the shaft on the hinge, the container having a projection that is receivable within any opening of the series of openings of the shaft, the container positioned at a respective vertical height on the shaft when the projection of the container is received within one opening of the series of openings of the shaft, wherein the container comprises a support plate and a bin, the support plate rotatably coupled to the shaft with the hinge, the support plate defining the projection, the bin receivable on the support plate when the projection of the support plate is disposed within one of the series of openings of the shaft, wherein the bin is removable from the support plate to permit height adjustment of the container via rotating the support plate relative to the cabinet on the shaft with the hinge when the bin is removed from the support plate, wherein the shaft comprises an inner tube and an outer tube, the inner tube received within the outer tube, the outer tube defining the series of openings, wherein the hinge comprises a tubular member and a pin, the outer tube of the shaft received within the tubular member of the hinge, the pin extending through the tubular member of the hinge and a post of the container such that the post of the container is rotatable relative to the tubular member of the hinge about the pin, and wherein each end portion of the inner tube is received by a respective bearing of the bracket such that the shaft is rotatable relative to the bracket.

2. The refrigerator appliance of claim 1, wherein the bracket is mounted to the cabinet such that the bracket is fixed relative to the cabinet.

3. The refrigerator appliance of claim 1, further comprising a door rotatably mounted to the cabinet, the bracket is mounted to the door such that the bracket is fixed relative to the door.

4. The refrigerator appliance of claim 3, wherein the container is rotatable relative to the door on the shaft with the hinge.

5. The refrigerator appliance of claim 1, wherein the hinge is positioned above all openings of the series of openings on the shaft.

6. The refrigerator appliance of claim 1, wherein the bin comprises a shroud that extends around at least a portion of the support plate at a bottom of the bin when the bin is disposed on the support plate.

7. A storage assembly for an appliance, comprising:

a bracket;

a shaft mounted to the bracket, the shaft defining a series of openings;

a hinge slidably mounted to the shaft; and a container mounted to the hinge such that the container is movable relative to the shaft on the hinge, the container having a projection that is receivable within any opening of the series of openings of the shaft, the container positioned at a respective vertical height on the shaft when the projection of the container is received within one opening of the series of openings of the shaft, wherein the container comprises a support plate and a bin, the support plate rotatably coupled to the shaft with the hinge, the support plate defining the projection, the bin receivable on the support plate when the projection of the support plate is disposed within one of the series of openings of the shaft, wherein the bin is removable from the support plate to permit height adjustment of the container by rotating the support plate on the shaft with the hinge when the bin is removed from the support plate, wherein the shaft comprises an inner tube and an outer tube, the inner tube received within the outer tube, the outer tube defining the series of openings, wherein the hinge comprises a tubular member and a pin, the outer tube of the shaft received within the tubular member of the hinge, the pin extending through the tubular member of the hinge and a post of the container such that the post of the container is rotatable relative to the tubular member of the hinge about the pin, and wherein each end portion of the inner tube is received by a respective bearing of the bracket such that the shaft is rotatable relative to the bracket.

8. The storage assembly of claim 7, wherein the openings of the series of openings are vertically distributed.

9. The storage assembly of claim 7, wherein the hinge is positioned above all openings of the series of openings on the shaft.

10. The storage assembly of claim 7, wherein the bin comprises a shroud that extends around at least a portion of the support plate at a bottom of the bin when the bin is disposed on the support plate.

* * * * *